US009610748B2

(12) United States Patent
Espe et al.

(10) Patent No.: US 9,610,748 B2
(45) Date of Patent: Apr. 4, 2017

(54) PRESS PLATEN OR ENDLESS BELT HAVING A SANDWICH-TYPE STRUCTURE

(75) Inventors: Oliver Espe, Bochum (DE); Rolf Espe, Bochum (DE)

(73) Assignee: Hueck Rheinische GmbH, Viersen (DE)

( * ) Notice: Subject to any disclaimer, the term of this patent is extended or adjusted under 35 U.S.C. 154(b) by 0 days.

(21) Appl. No.: 14/114,535

(22) PCT Filed: Jun. 26, 2012

(86) PCT No.: PCT/EP2012/002684
§ 371 (c)(1),
(2), (4) Date: Oct. 29, 2013

(87) PCT Pub. No.: WO2013/000563
PCT Pub. Date: Jan. 3, 2013

(65) Prior Publication Data

US 2014/0099395 A1 Apr. 10, 2014

(30) Foreign Application Priority Data

Jun. 29, 2011 (EP) ..... 11005298

(51) Int. Cl.
*B30B 15/06* (2006.01)
*B30B 9/28* (2006.01)

(52) U.S. Cl.
CPC ..... *B30B 9/28* (2013.01); *B30B 15/062* (2013.01)

(58) Field of Classification Search
CPC ..... B30B 9/28; B30B 15/062
USPC ..... 425/385, 470
See application file for complete search history.

(56) References Cited

U.S. PATENT DOCUMENTS

| | | | | |
|---|---|---|---|---|
| 3,532,587 | A | 10/1970 | Israel Ungar et al. | |
| 8,932,632 | B2 * | 1/2015 | Yadav | C03C 27/10 156/284 |
| 2010/0119782 | A1 * | 5/2010 | Ohgane | 264/2.5 |

FOREIGN PATENT DOCUMENTS

| | | | |
|---|---|---|---|
| CN | 1041914 | A | 5/1990 |
| DE | 102007062123 | A1 | 6/2009 |
| DE | 202009014669 | U1 | 1/2010 |
| JP | 56169036 | A | 12/1981 |
| WO | 2006136949 | A2 | 12/2006 |
| WO | 2011051116 | A1 | 5/2011 |

* cited by examiner

*Primary Examiner* — Joseph S Del Sole
*Assistant Examiner* — Thukhanh T Nguyen
(74) *Attorney, Agent, or Firm* — Michael Soderman

(57) ABSTRACT

The present invention relates to a press platen (1) or endless belt for embossing materials, in particular wooden materials or plastics materials. In order to considerably reduce the production costs and the use of material, it is proposed according to the invention that use is made of a sandwich body which consists of a carrier body (10) and an embossing body (11), wherein said bodies are connected together in a firm and planar manner via a magnetically active and/or metallic adhesive agent (12). As a result of the selection of the adhesive agent, for example in the form of a magnetic film or magnetic materials, a hard or soft solder or a soldering paste, it is thus possible to break the connection in a reversible manner at any time and thus to exchange the embossing body (11).

8 Claims, 2 Drawing Sheets

PRESS PLATEN OR ENDLESS BELT HAVING A SANDWICH-TYPE STRUCTURE

CROSS REFERENCE TO RELATED APPLICATIONS

This application is the U.S. national stage of International Application No. PCT/EP2012/002684 filed on Jun. 26, 2012, and claims the benefit thereof. The international application claims the benefit of EP 11005298.2 filed on Jun. 29, 2011; all applications are incorporated by reference herein in their entirety.

BACKGROUND

The invention relates to a press platen or endless belt for embossing materials, in particular wooden materials or plastic materials, by means of surface structuring and a process for manufacturing the press platens or endless belts as per the invention.

Press platens or endless belts are required to press wooden plates with decor paper and/or overlay paper. The entire surface of the wooden plates is coated here with aminoplast resin films, also called thermoset resins. The processing takes place in single-daylight short-cycle presses, multi-daylight presses or double-belt presses, for example. The completed press platens or endless belts are used in the presses to provide the wooden materials that are to be manufactured with a desired surface structure. Registered embossing is used here as a preference, but not exclusively. This means that an assigned decor paper is used with an aligned press platen or an endless belt so that the structure of the decor paper can be raised in relief when embossed into the surface. The structures that are used in connection with this can have a natural origin, for instance an imitation of a wood-pore structure or stone surface. The possibility also exists to manufacture any desired structures in accordance with customer requests.

The decor and overlay paper is preferably made of thermoset resins, which transition into a liquid form because of the pressure and temperature in the press system and which form a secure bond with the wooden material with a rising level of cross-linkage and a simultaneous increase in the resin viscosity in the final state. Melamine resins, phenolic resins and melamine/urea resins, which have turned out to be especially suitable, are among the thermoset resins that are used. The melamine resin liquefies during the pressing process with pressure and heat, and further polycondensation takes place. The pressing time and temperature determine the degree of cross-linkage of the melamine resins and their surface quality. After the pressing period ends, the melamine resin has the desired degree of cross-linkage and has transitioned into a solid phase; a realistic surface design that reproduces the surface of the embossing tool is obtained via the simultaneous structured embossing of the melamine resin surface.

In the prior art, embossing tools in the form of press platens or endless belts are made of sheet steel; they get the required surface structure via appropriate processing. Different methods are known for this, for instance the creation of an etch resist by applying a screen-printing process so that subsequent etching of the press platen can be done. The plates that are used in connection with this have a very large format, so very precise processing and, in particular, further aligned processing is important if further work steps are required. There are always several work steps with especially deep structures have to be etched and several etching operations are required for this with a previously applied etch resist. All of the areas that are supposed to form the raised areas of the surface structure later on are covered by the mask in the etching processes, so the surface will only be etched in the areas that can be directly corroded by the etching fluid. The etched-out areas then form the profile valleys of the desired structure; the surface is cleaned and, in particular, the mask is removed after the end of the etching process.

Alternatively, the possibility exists to apply a photo layer that is subsequently exposed to light in order to subject the press platens or the endless belts to an etching process after the subsequent development of the photo layer, where a portion of the photo layer remains as an etch resist. It is very difficult and problematic to reproduce the masks that are created in this way, because the etch resist layers that are to be applied have to always be arranged in the same position when especially deep structures are to be etched.

Furthermore, instead of a screen-printing process, the creation of a mask via the application of wax or alternatively the use of a UV lacquer, which is directly printed onto the press platens and endless belts to be processed with the aid of a digital printing process, is known from the state of the art. After the etching, which may have to be repeated a number of times, especially deep structures can be created here that are aligned to a high degree because of the use of the digitalized printing process.

A further alternative that is known from the prior art is to directly create the required structure on the surface with the aid of a laser process; the deep structure to be produced is directly created with the aid of a laser. The laser is also precisely controlled with the aid of a digital printing technique with this method, so the press platens or endless belts are a 100% match with the decor paper after they are completed. The level required to create a match of the necessary press-platen structures with the decor paper has only been achieved with the processes for surface structuring that have recently been developed.

After the press platens or endless belts have been completed, they can be subjected to further process steps to obtain special effects, for instance to influence the degree of gloss. The degree of gloss provided can range from matte or silk matte to shiny; the wooden plates have a desired surface structure with a lustrous effect that comes very close to that of naturally grown wood because of this. Wood-pore structures are preferably produced with these methods, but imaginative surface designs can likewise be created or leather, tile or natural-stone surfaces can be imitated. Any conceivable structure can be created with this method.

The overlay paper could be doped with abrasion-resistant particles, for instance corundum, so that the end consumer has a high level of wear resistance depending on the intended use of the manufactured wooden plates, for instance in the wall area, but also in the floor area. But this wear resistance leads to negative effects on the press platens or endless belts that are used. There is a relative movement between the processed wooden material with the pressed surfaces and the press platen or endless belt after every pressing operation and an opening of the presses, so the surface structure is gradually worn down. It is necessary to completely rework the press platen or replace it with a new press platen in a case of that type. The press platens have to already be reconditioned after a relatively short period of use for coatings, for instance of HDF plates (high density fiberboard) and laminated floor coverings. The reason for that is the high proportion of corundum that is used in the melamine resin films to increase the wear resistance, which is why the chrome-plated surfaces wear down relatively quickly. The production of a press platen is very complicated and cost-intensive; the plan is to scrap them at the end of the service life. This is because of the fact, among other things, that the blanks of the press platens or endless belts are first provided with a direction-free, intermediate finish and have to additionally be polished ahead of the surface structuring before new structuring can take place, so the thickness of the press platens or endless belts will gradually no longer be at the required dimension after several instances of rework. The complex structure creation, for instance according to the classical etching method, application of the etching resist, etching with iron(III) chloride, as an example, creation of a degree of gloss via sandblasting, for instance, and subsequent surface sealing, for example chrome plating, or alternatively via the creation of the structure with the aid of laser engraving. Likewise, the press-platen surfaces usually have to be completely ground and reworked when there is mechanical damage. This leads to a situation in which the relatively expensive base press platens only remain conditionally operational, and they have to be scrapped after around four to six instances of reconditioning, because they become too unstable as a result of their thickness and cannot be fixed in place in a consistent way in the press system.

DETAILED DESCRIPTION

The invention is based on the problem of proposing a new type of press platen or endless belt for single-daylight or multi-daylight presses or double-belt presses that makes economical production and longer usage times of the carrier plates possible vis-a-vis conventional press platens or endless belts.

To solve the problem, the invention envisages a carrier body that is joined to an embossing body with surface structuring via an adhesive agent. Further advantageous design forms of the invention follow from the sub-claims.

A proposal is made as per the invention to use a carrier body that is joined to an embossing body via an adhesive agent, wherein only the embossing body has surface structuring, as opposed to the previous method with a base material that forms the press platen or endless belt and that is given surface structuring. The embossing body can consequently be manufactured in a cost-effective way independently of the carrier body and joined via the adhesive agent to the carrier body in such a way that this can be used in the intended way for single-daylight or multi-daylight presses. After the surface structuring has been worn down, the possibility subsequently exists to remove the embossing body from the carrier body and to replace it with a new embossing body. The amount of material that has to be used in connection with this is significantly reduced because the carrier body can be used over and over again, and just an extremely thin layer in the form of an embossing body has to be replaced.

The carrier body, comprised of stainless steel, as an example, for instance AISI No. 630, AISI 410 or AISI 304, or brass, is first prepared for this as in the prior art. Instead of the customary surface structuring of the press platen or endless belt by means of an etching technology or digital laser engraving, the embossing body is manufactured, i.e. provided with a surface structure, independently of the carrier body. After that, the carrier body and the embossing body are bonded to one another over the entire surface and in a firm but reversible way with the aid of an adhesive agent so that a sandwich structure arises. This sandwich structure has the special advantage that the expensive carrier body remains when reconditioning is done later on and only the embossing body has to be replaced. Production costs and raw-material costs are saved to a considerable extent because of this measure. Furthermore, the embossing body, which is substantially thinner and more inexpensive than the carrier body, can already be prefabricated and put in stock for the respective customer. Time is saved and the delivery times are shortened to a considerably degree because of this.

An embodiment of the invention envisages that the carrier body has at least a smooth or structured surface. The press platen in the form of a sandwich as per the invention can, as an example, be used to emboss smooth surfaces but likewise to emboss structured surfaces. The approach used depends on the customer's desires; both types of embossing could be done in an advantageous way with the aid of a sandwich structure. The background is that smooth embossing bodies can also be damaged by impurities in the course of the service life and therefore become inoperative. But the same carrier body can be used again because of the replacement of the embossing body, and this leads to the above-mentioned advantages.

Alternatively, the adhesive agent can be comprised of solder, for instance gold solder, tin solder, silver solder, platinum solder, brass solder, phosphorus solder or solder containing antimony, lead, aluminum or silicon, a soldering paste or similar types of solder that are arranged at least partially, preferably over the full surface, between the carrier body and the embossing body. A reversible bond between the carrier body and the embossing body is possible with the aid of solder; the special advantage comes about that the solder that is used is an excellent heat conductor, and the heat can consequently be directly conducted to the surface of the material plates during the pressing operation to join the overlay paper to the wooden material via polycondensation. Furthermore, the possibility exists to either partially or fully join the carrier body to the embossing body via the use of solder foil; a slight separation of the carrier body and the embossing body is possible by heating both of the bodies over the melting point of the solder that is used. If solder is used in a foil form, there is simultaneously assurance that there will only be a small layer thickness and, moreover, the forces that arise for the pressing will likewise be reliably transferred to the material to be processed, just like the required heat.

First off with regard to this, the carrier body will be at least partially be made of a metal, preferably aluminum, nickel, zinc, copper, brass or stainless steel, for instance AISI No. 630, AISI 410 or AISI 304, and/or the embossing body will at least partially be made of a magnetic material, wherein the thickness can be chosen in dependence upon the structural depth, preferably 0.3 to 3.0 mm with a special preference for 0.3 to 1.5 mm.

The adhesive agent is doped with a metal powder, for instance copper, brass, aluminum or iron, to increase the heat transfer coefficient of the press platens or endless belts as per the invention; heating of the material plates is absolutely necessary in the single-daylight or multi-daylight presses. The adhesive agents employed in connection with this can be used at temperatures of up to 250° C., so there will not be a premature detachment of the embossing body, for instance at the temperatures of around 220° C. that arise to manufacture the material plates. At the same time, however, the adhesive agents can be annealed at temperatures above 250° C., so the embossing body can be detached without further ado from the carrier body.

Alternatively, the possibility exists for the adhesive agent to be made up of magnetic materials. Adhesive agents of that type are always suitable when the carrier body and the embossing body are both made of steel and consequently have magnetic characteristics. A magnetic foil with high temperature resistance that ensures, as the adhesive agent, an extensive, firm bond between the two bodies can be used, for instance, to join the carrier body and the embossing body. If a magnetic foil is used, a cross-linked silicone elastomer will be employed, as an example, with the addition of magnetic materials with high-temperature resistance, for instance samarium/cobalt, aluminum/nickel/cobalt, neodymium/iron/boron, barium or strontium ferrites or soft ferrites such as manganese/zinc. All of the above-mentioned permanent magnetic materials only lose a very small amount of their holding force, around 15% to 20% at the existing operating temperatures of around 220° C. The share of magnetic materials depends on the desired holding force of the materials in each case minus the loss in holding power at the respective operating temperature and the overall weight of the embossing body. These constraints can be given consideration without any problems, however, so a permanent and reversible bond between the carrier body and the embossing body can already be created with the aid of magnetic foil. At the same time, the magnetic foil offers the possibility of separating the two bodies from one another without residues, so the embossing body can be quickly replaced when it is worn out.

Methods known in the prior art, for instance etching technologies or laser engraving, are used to manufacture the embossing bodies; they will preferably be thin and will consequently be able to be processed in a much less complicated way. One possibility for this is to mount an embossing body in the form of a metal foil or piece of thin sheet metal on a steel cylinder for surface structuring; the diameter of the steel cylinder can be adapted to the maximum width of the press platens, so the embossing body can be joined to the carrier body after completion of the embossing body and after removal of the steel cylinder.

If metal foils or pieces of thin sheet metal or other materials, for instance steel or brass, are used, they can be mounted on the steel cylinder and then correspondingly engraved; the above-mentioned steps are taken here until the surface structuring is finished. The metal foils or pieces of thin sheet metal that are produced in this way are then cut to the size of the carrier body and joined to it, so the press platen or endless belt is available for further use.

Alternatively, the possibility exists to electroplate a Ballard shell of approx. 100 μm onto a copper base layer; a separating layer can be arranged between the base layer and the Ballard shell so that it is possible to remove the Ballard shell later on. A removable copper layer on a gravure cylinder is called a Ballard shell in gravure printing. The gravure cylinder made of steel covers a base copper layer with a thickness of around 2 mm onto which a second copper layer, the so-called Ballard shell, is electroplated. The separating layer is between the 100 μm Ballard shell and the base body, so the Ballard shell can simply be removed after the engraving and replaced by a new one. After the copper layer is electroplated on it can also be polished, and the surface structuring is done after that, for instance by means of a laser. The completed engraved surface is subsequently electroplated with a chrome layer to increase the wear resistance; further processing steps can ensue in individual cases to influence the degree of gloss, for example. To remove the Ballard shell, it is opened at one end of the steel cylinder as a rule and then pulled down with pliers and removed. The steel cylinder itself can then be used again for the next production run.

A metal is preferably used for the carrier body, for instance stainless steel such as AISI No. 630, AISI 410 or AISI 304 or, alternatively, a brass sheet. The embossing body, on the other hand, can be made of copper, brass or stainless steel; the thickness can be freely chosen in dependence upon the required structural depth, preferably at 0.3 to 3.0 mm, with a special preference for 0.3 to 1.5 mm.

The important advantages of the newly designed press platens or endless belts involve the later separation of the carrier body and the embossing body here; the embossing body is exposed to significantly greater wear than the carrier body. The carrier body can therefore be used a number of times and is newly joined to an embossing body over and over again; a hard or soft solder or a solder past is preferably used. Alternatively, a bond can be created with the aid of magnetic materials, especially a magnetic adhesive foil, in order to obtain the desired benefits.

This invention is also based on the problem of setting forth a method for manufacturing the novel press platens or endless belts. To save on materials and costs, it is envisaged that the production of a press platen or an endless belt to emboss materials, especially wooden materials or plastic materials, will be done with the aid of a carrier body and an embossing body, wherein

- the embossing body is provided with surface structuring via an etching process, a rolling process, a pressing process or laser engraving,
- the carrier and/or embossing body is supplied with an adhesive agent and
- both of the bodies, the carrier body and the embossing body, are joined to one another with the adhesive agent.

The method that is being set forth distinguishes itself by exceptional economic efficiency and, furthermore, it makes multiple instances of reuse of the carrier body possible; the carrier body is exposed to hardly any wear. The embossing bodies in the form of a thin metal foil or thin sheet metal that are used in connection with this can be reversibly removed from the carrier body, so only a minor amount of reconditioning of the carrier bodies is required. A substantial amount of processing time is saved because of this and, moreover, a substantial amount of potential savings arise via the use of thin sheet metal or metal foil with surface structuring, especially due to the fact that the materials to be processed, for instance wooden materials with overlay paper and decor paper, cause wear of the embossing bodies. The special advantage results here via the reversible joining of the carrier and embossing bodies.

A further advantage of these press platens or endless belts as per the invention involves the fact that fewer high-quality metals are used for the carrier body and the manufacturing costs can consequently be reduced to a considerable extent. The use of high-quality stainless steel that makes it possible to effect the required surface structuring was previously necessary. But consideration no longer has to be given to that, because the surface structuring only takes place on the surface of the embossing body.

Material plates that distinguish themselves by having a smooth or at least partially structured surface are manufactured using the process characteristics and the apparatus required to carry out the process.

BRIEF DESCRIPTION OF THE DRAWINGS

The invention will be described once again below with the aid of two figures.

DETAILED DESCRIPTION OF THE PREFERRED EMBODIMENT

Figure 1:
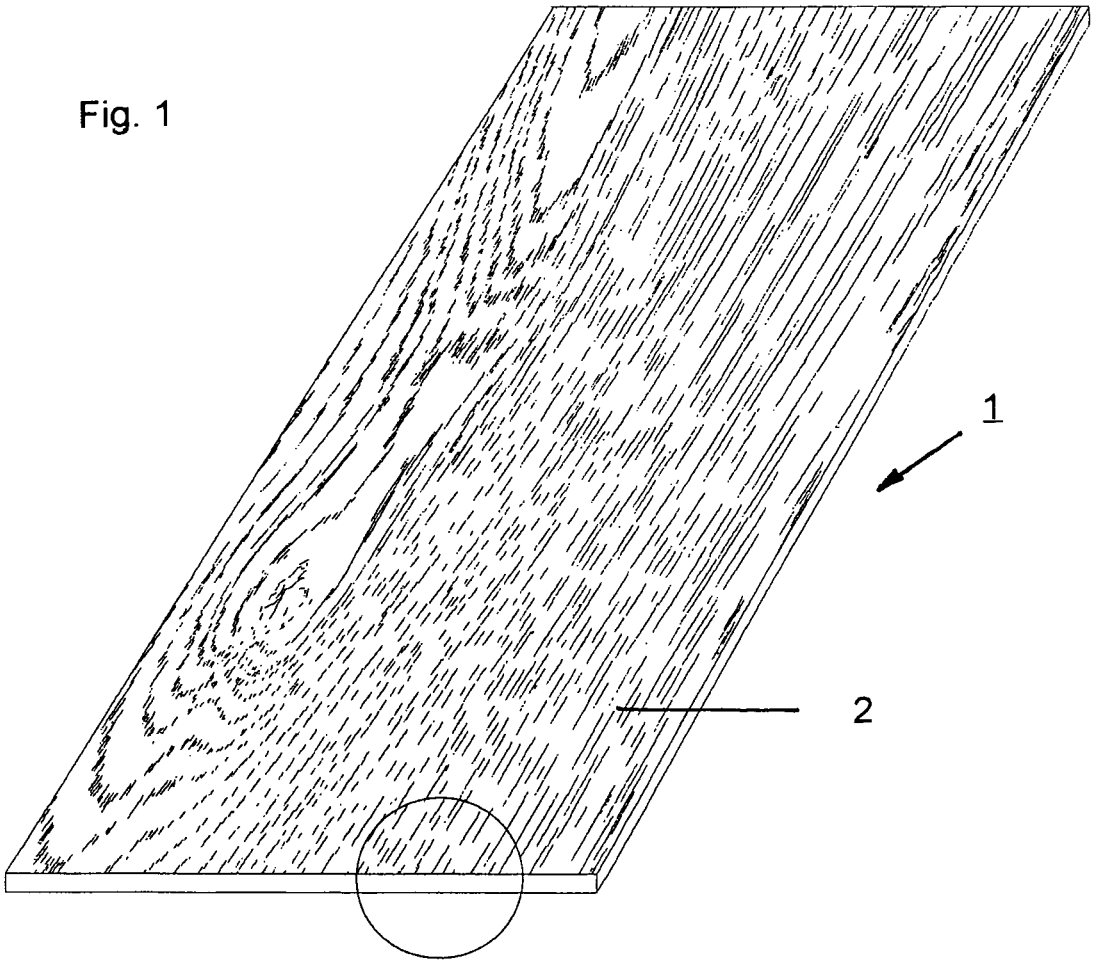
FIG. 1 shows a manufactured press platen with a woodpore structure in a perspective view and FIG. 2 shows the structure of the press platen in an enlarged sectional view.

FIG. 1 shows, in a perspective view, a press platen 1 in accordance with the invention that is designed to be flat in the example that is shown. This embossing tool can also be designed to be curved in the case of an endless belt, however. The press platen 1 shows a grain 2 that is replicated in the form of a wood-pore structure as an example. It is conceivable, however, that other kinds of grain or other surface characteristics of this type can be created with the process in accordance with the invention and the etching or laser process that is required for that.

Figure 2:
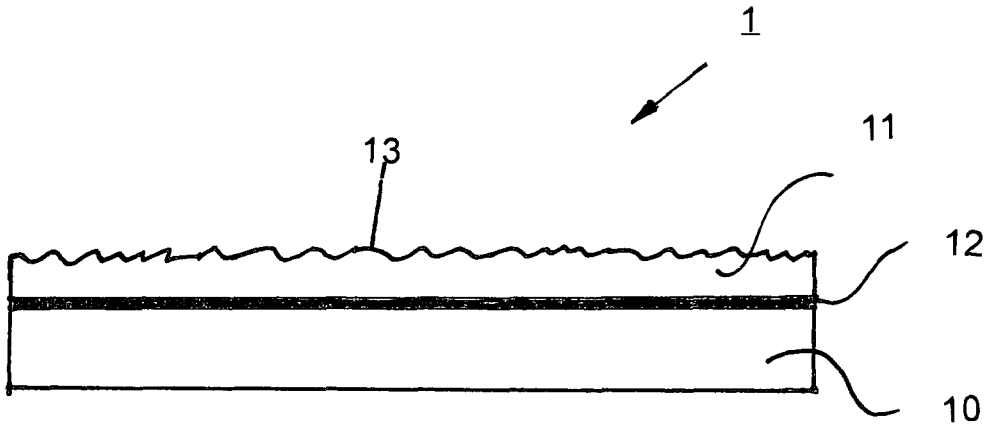

FIG. 2 shows, in an enlarged side view, a part of the front edge area of the press platen 1 and the surface structuring on it. As is especially evident from FIG. 2, the press platen 1 is comprised of a carrier body 10, an embossing body 11 and an adhesive agent 12. The adhesive agent 12 makes it possible to remove the embossing body 11 from the carrier body 10. The carrier body 10 can consequently be used again, whereas the worn-out embossing body 11, in contrast, is replaced. The surface structuring 13 on the embossing body 11 is created with the aid of known etching technologies or laser engraving, for instance; a layer thickness of the embossing body of 0.3 to 3 mm, preferably 0.3 to 1.5 mm, is used. To manufacture the embossing body 11, the possibility exists to mount it on a steel cylinder in order to produce the surface structuring 13 via an etching technology or a laser process. After the production and further treatment of the embossing body 11, for instance chrome plating and other steps to influence the degree of gloss, it is joined to the carrier body 10 with the aid of the adhesive layer 12.

A special advantage of these press platens or endless belts as per the invention involves the fact that fewer high-quality metals can be used for the carrier body 10 and the manufacturing costs can consequently be reduced to a considerable extent. The use of high-quality stainless steel that makes it possible to effect the required surface structuring was previously necessary. But consideration no longer has to be given to that, because the surface structuring only takes place on the surface of the embossing body.

LIST OF REFERENCE NUMERALS

1 Press platen
2 Grain
10 Carrier body
11 Embossing body
12 Adhesive agent
13 Surface structuring

The invention claimed is:

1. An embossing tool for embossing wooden materials or plastic materials via surface structuring of an embossing body made of metal, said embossing body being manufactured independently of a carrier body made of metal, wherein the carrier body is connected to the embossing body via an adhesive agent comprised of a magnetic foil with high temperature stability used with a cross-linked silicone elastomer with the addition of magnetic materials with high-temperature resistance, ensuring an operating temperature of 220° C., and wherein the carrier body and the embossing body form a sandwich structure and are reversibly joined to one another, enabling the embossing body to be removed from the carrier body and replaced with no residue.

2. The embossing tool according to claim 1, wherein the carrier body has surface structuring.

3. The embossing tool according to claim 1, wherein the carrier body is at least partially made of a metal, preferably aluminum, nickel, zinc, copper, brass or stainless steel, for instance AISI No. 630, AISI 410 or AISI 304, and/or that the embossing body is at least partially made of a magnetic metal, wherein the thickness can be chosen in dependence upon the structural depth, preferably 0.3 to 3.0 mm with a special preference for 0.3 to 1.5 mm.

4. The embossing tool according to claim 1, wherein the magnetic foil is supplied with additives of magnetic materials with high temperature resistance, for instance samarium/cobalt, aluminum/nickel/cobalt, neodymium/iron/boron, barium or strontium ferrites or soft ferrites such as manganese/zinc compounds.

5. The embossing tool according to claim 1, wherein the embossing body is designed to be a Ballard shell, for instance in the form of a removable metal layer.

6. The embossing tool according to claim 1, wherein a Ballard shell comprised of metal foil or thin sheet metal is mounted on a steel cylinder for surface structuring, wherein the diameter of the steel cylinder can be adapted to the maximum width of the press platens, enabling simple removal and replacement of the Ballard shell.

7. The embossing tool according to claim 2, wherein the surface structuring of the embossing body can be created via an etching process or laser-engraving process.

8. An embossing tool for embossing wooden materials or plastic materials via surface structuring of an embossing body made of metal, said embossing body being manufactured independently of a carrier body made of metal, wherein only the embossing body has surface structuring, wherein the carrier body is connected to the embossing body via an adhesive agent and wherein the carrier body and the embossing body form a sandwich structure and are reversibly joined to one another, enabling the embossing body to be removed from the carrier body and replaced with no residue, wherein the adhesive agent is comprised of an adhesive with high temperature stability doped with metal powder that may be employed up to temperatures of 250° C. and that is heated above temperatures of 250° C. to enable detachment.

* * * * *